US010065236B2

(12) United States Patent
Lin

(10) Patent No.: US 10,065,236 B2
(45) Date of Patent: Sep. 4, 2018

(54) INJECTION SYSTEM APPLIED TO A DIE CASTING MACHINE

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 93 days.

(21) Appl. No.: 15/416,009

(22) Filed: Jan. 26, 2017

(65) Prior Publication Data

US 2018/0126453 A1 May 10, 2018

(30) Foreign Application Priority Data

Nov. 9, 2016 (TW) ..... 105217080 U

(51) Int. Cl.
*B22D 17/20* (2006.01)
*B22D 17/08* (2006.01)

(52) U.S. Cl.
CPC ..... *B22D 17/203* (2013.01); *B22D 17/08* (2013.01); *B22D 17/2053* (2013.01)

(58) Field of Classification Search
CPC ... B22D 17/203; B22D 17/08; B22D 17/2053
See application file for complete search history.

(56) References Cited

U.S. PATENT DOCUMENTS 5,031,686 A * 7/1991 Kidd ..... B22D 17/04 164/120

* cited by examiner

*Primary Examiner* — Kevin P Kerns
*Assistant Examiner* — Steven S Ha
(74) *Attorney, Agent, or Firm* — Li & Cai Intellectual Property (USA) Office

(57) ABSTRACT

An injection system applied to a die casting machine includes a container module, a first mold module, a feeding module, and an abutting module. The container module includes a container casing member. The first mold module includes a first inlet structure partially embedded into the container casing member, and a second inlet structure partially embedded into the container casing member. The feeding module includes a first feeding assembly and a second feeding assembly. The abutting module is disposed on the container casing member for downwardly abutting the first feeding assembly and the second feeding assembly. The abutting module downwardly abuts the first feeding assembly so as to firmly position the first feeding assembly on the first inlet structure. The abutting module downwardly abuts the second feeding assembly so as to firmly position the second feeding assembly on the second inlet structure.

10 Claims, 13 Drawing Sheets

INJECTION SYSTEM APPLIED TO A DIE CASTING MACHINE

BACKGROUND OF THE INVENTION

1. Field of the Invention

The present disclosure relates to an injection system, and more particularly to an injection system applied to a die casting machine.

2. Description of Related Art

In a die casting machine, an injection plunger is used to inject a molten metal into a cavity of a die by an injection plunger. The quality of the cast product greatly depends upon the injection speed of the molten metal and the casting pressure. Therefore, it is necessary to suitable control the speed of movement and pressure of the injection cylinder driving the injection plunger. That is, the injection speed and the casting pressure are controlled in accordance with the state of filling the molten metal between the casting cycles to realize the optimal injection operation.

For example, in a predetermined zone after the start of injection, the injection plunger is made to move by a low injection speed so that the molten metal in the injection sleeve does not enter air. Next, when the front end of the molten metal reaches the inlet of the cavity, the injection speed is switched from low speed to high speed to make the injection plunger move by a high injection speed so as to complete the filling of the molten metal into the cavity before the molten metal cools and solidifies. After the molten metal finishes being filled into the cavity, the casting pressure is rapidly increased and the molten metal is allowed to solidify while applying pressure to the molten metal in the cavity.

SUMMARY OF THE INVENTION

One aspect of the present disclosure relates to an injection system applied to a die casting machine.

One of the embodiments of the present disclosure provides an injection system applied to a die casting machine, including a container module, a first mold module, a second mold module, a pipe module, a feeding module and an abutting module. The container module includes a container casing member. The first mold module includes a first mold structure embedded into the container casing member, a first inlet structure disposed on the first mold structure and partially embedded into the container casing member, and a second inlet structure disposed on the first mold structure and partially embedded into the container casing member. The first inlet structure has a first top surface, and the second inlet structure has a second top surface. The second mold module includes a second mold structure. The pipe module includes a first pipe body connected between the first mold structure and the second mold structure and embedded into the container casing member, and a second pipe body connected to the second mold structure. The feeding module includes a first feeding assembly having a first pressing board and a second feeding assembly having a second pressing board. The first pressing board and the second pressing board are respectively disposed on a topmost side of the first feeding assembly and a topmost side of the second feeding assembly, the first feeding assembly is disposed on the first top surface of the first inlet structure and in fluid communication with the first inlet structure, and the second feeding assembly is disposed on the second top surface of the second inlet structure and in fluid communication with the second inlet structure. The abutting module includes a first pivot seat positioned on the container casing member, a second pivot seat positioned on the container casing member, two first abutting structures respectively pivotably disposed on the first pivot seat and the second pivot seat for concurrently downwardly abutting the first pressing board, a first adjusting member rotatably disposed between the two first abutting structures for adjusting a distance between the two first abutting structures, two second abutting structures respectively pivotably disposed on the first pivot seat and the second pivot seat and concurrently downwardly abutting the second pressing board, and a second adjusting member rotatably disposed between the two second abutting structures for adjusting a distance between the two second abutting structures. The two first abutting structures downwardly abut against the first pressing board so as to firmly position the first feeding assembly on the first top surface of the first inlet structure. The two second abutting structures downwardly abut against the second pressing board so as to firmly position the second feeding assembly on the second top surface of the second inlet structure.

Another one of the embodiments of the present disclosure provides an injection system applied to a die casting machine, including a container module, a first mold module, a feeding module, and an abutting module. The container module includes a container casing member. The first mold module includes a first inlet structure partially embedded into the container casing member, and a second inlet structure partially embedded into the container casing member. The first inlet structure has a first top surface, and the second inlet structure has a second top surface. The feeding module includes a first feeding assembly and a second feeding assembly. The first feeding assembly is disposed on the first top surface of the first inlet structure and in fluid communication with the first inlet structure, and the second feeding assembly is disposed on the second top surface of the second inlet structure and in fluid communication with the second inlet structure. The abutting module includes two first abutting structures and two second abutting structures. The two first abutting structures downwardly abut against the first feeding assembly so as to firmly position the first feeding assembly on the first top surface of the first inlet structure. The two second abutting structures downwardly abut against the second feeding assembly so as to firmly position the second feeding assembly on the second top surface of the second inlet structure. The container casing member has an inner surface, the first top surface of the first inlet structure and the inner surface of the container casing member are flush with each other, and the second top surface of the second inlet structure and the inner surface of the container casing member are flush with each other.

Yet another one of the embodiments of the present disclosure provides an injection system applied to a die casting machine, including a container module, a first mold module, a feeding module, and an abutting module. The container module includes a container casing member. The first mold module includes a first inlet structure partially embedded into the container casing member, and a second inlet structure partially embedded into the container casing member. The feeding module includes a first feeding assembly and a second feeding assembly. The first feeding assembly is disposed on the first inlet structure, and the second feeding assembly is disposed on the second inlet structure. The abutting module is disposed on the container casing member for downwardly abutting the first feeding assembly and the second feeding assembly. The abutting module downwardly abuts the first feeding assembly so as to firmly position the first feeding assembly on the first inlet structure. The abutting module downwardly abuts the second feeding assembly so as to firmly position the second feeding assembly on the second inlet structure.

Therefore, the abutting module is disposed on the container casing member for downwardly abutting the first feeding assembly and the second feeding assembly, so that the first feeding assembly and the second feeding assembly can be respectively firmly positioned on the first inlet structure and the second inlet structure through the abutting module.

To further understand the techniques, means and effects of the present disclosure applied for achieving the prescribed objectives, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Figure 1:
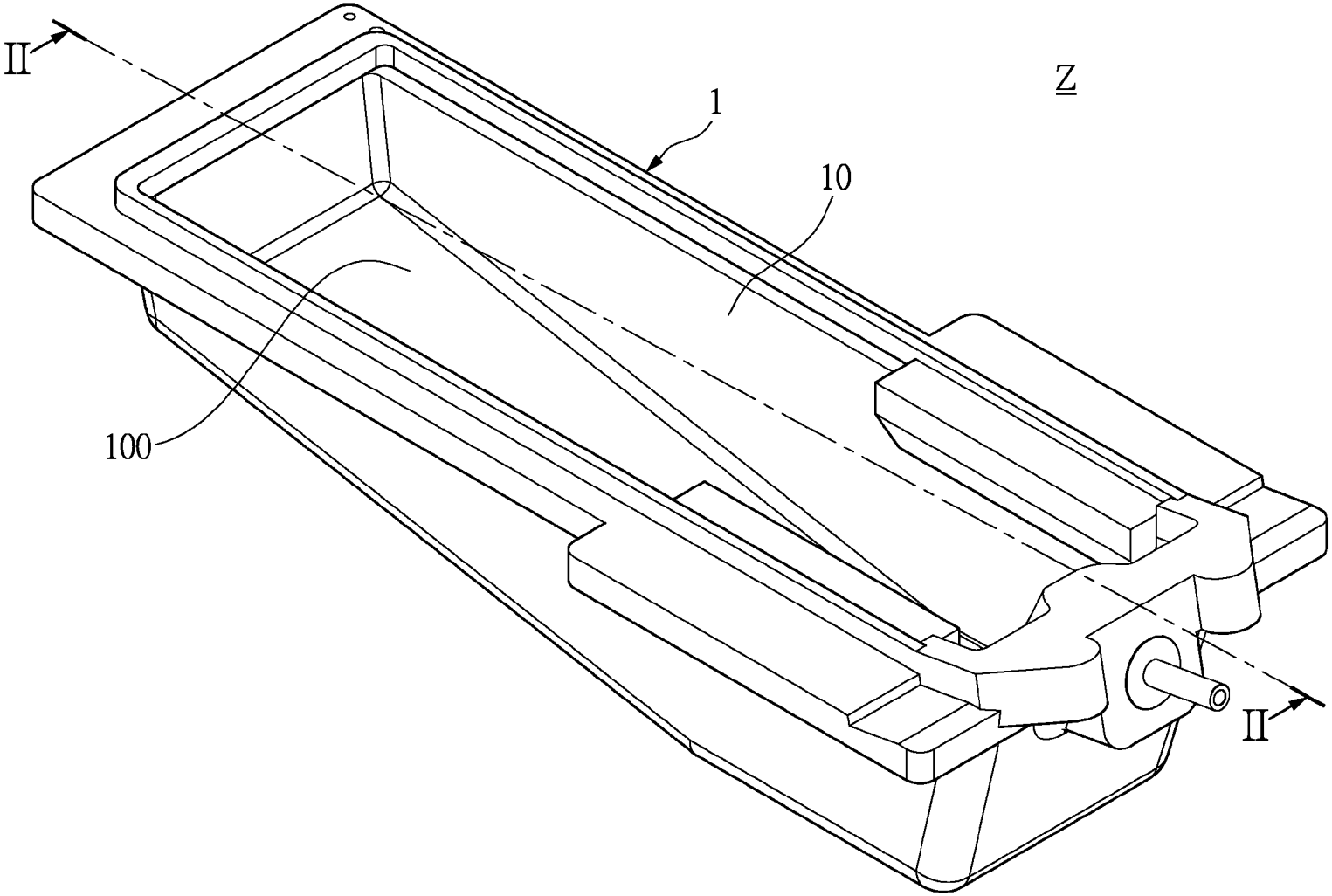
FIG. 1 shows a perspective schematic view of an injection system applied to a die casting machine according to the present disclosure.
Figure 2:
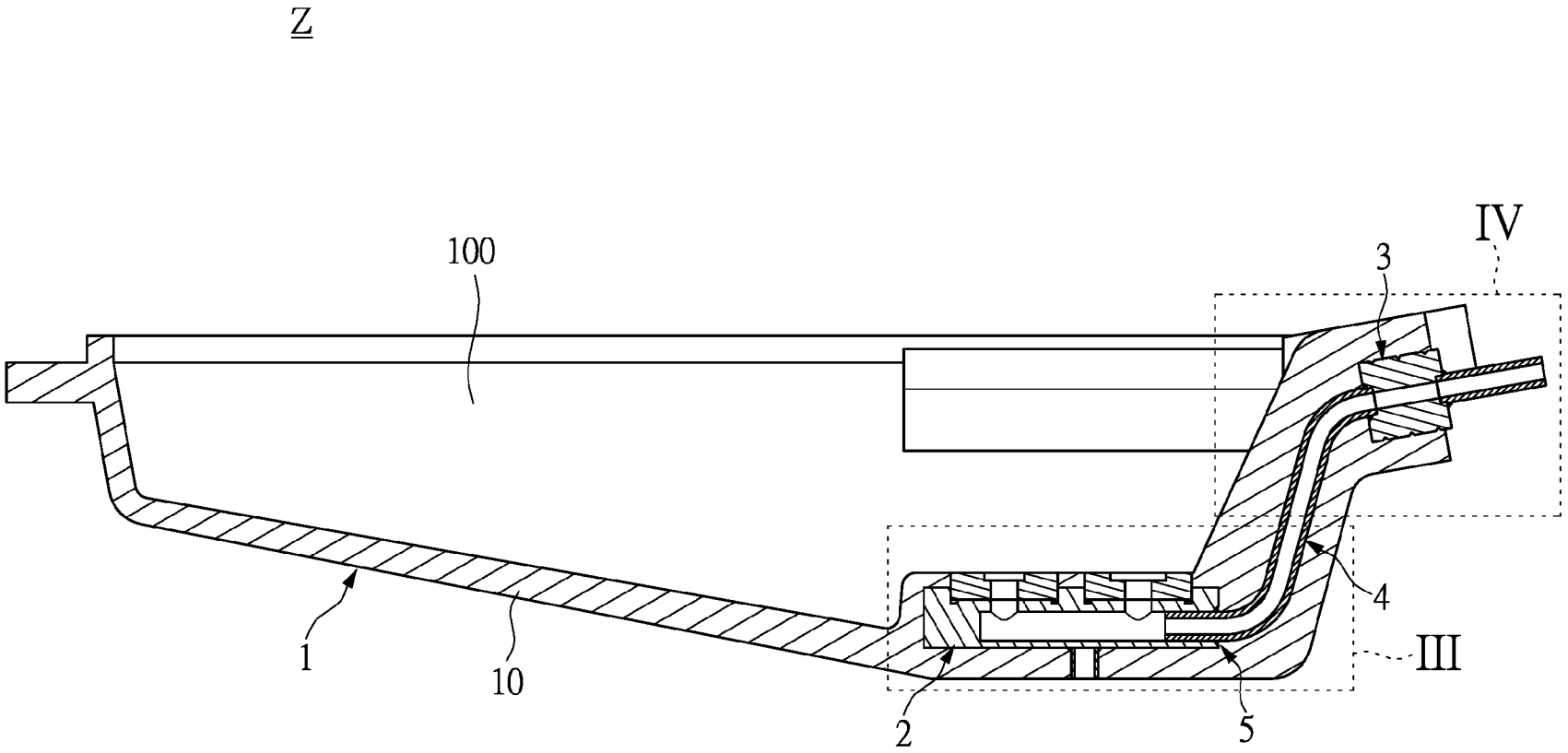
FIG. 2 shows a cross-sectional view taken along the section line II-II of FIG. 1.

The embodiments of "an injection system applied to a die casting machine" of the present disclosure are described. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

Referring to FIG. 1 to FIG. 6, the present disclosure provides an injection system Z applied to a die casting machine, including a container module 1, a first mold module 2, a second mold module 3, and a pipe module 4.

First, referring to FIG. 1 to FIG. 4, the container module 1 includes a container casing member 10 having a material receiving space 100 for receiving metal materials, and the container casing member 10 has an inner surface 1000. More precisely, the container casing member 10 has a first groove 1001 and a second groove 1002. For example, the container casing member 10 may be a zinc pot or any metal pot.

Moreover, referring to FIG. 3 to FIG. 6, the first mold module 2 includes a first mold structure 20 embedded into the container casing member 10, a first inlet structure 21 (such as a first inlet reinforcing structure) disposed on the first mold structure 20 and partially embedded into the container casing member 10, and a second inlet structure 22 (such as a second inlet reinforcing structure) disposed on the first mold structure 20 and partially embedded into the container casing member 10. More precisely, the first inlet structure 21 is received inside the first groove 1001 of the container casing member 10, and the second inlet structure 22 is received inside the second groove 1002 of the container casing member 10. In addition, the first mold structure 20 has a first inner guide channel 200, a first left inlet 201 communicated with the first inner guide channel 200, a first right inlet 202 communicated with the first inner guide channel 200, and a first outlet 203 communicated with the first inner guide channel 200. The first inlet structure 21 has a first communication opening 210 communicated between the material receiving space 100 and the first left inlet 201, and the second inlet structure 22 has a second communication opening 220 communicated between the material receiving space 100 and the first right inlet 202.

Figure 3:
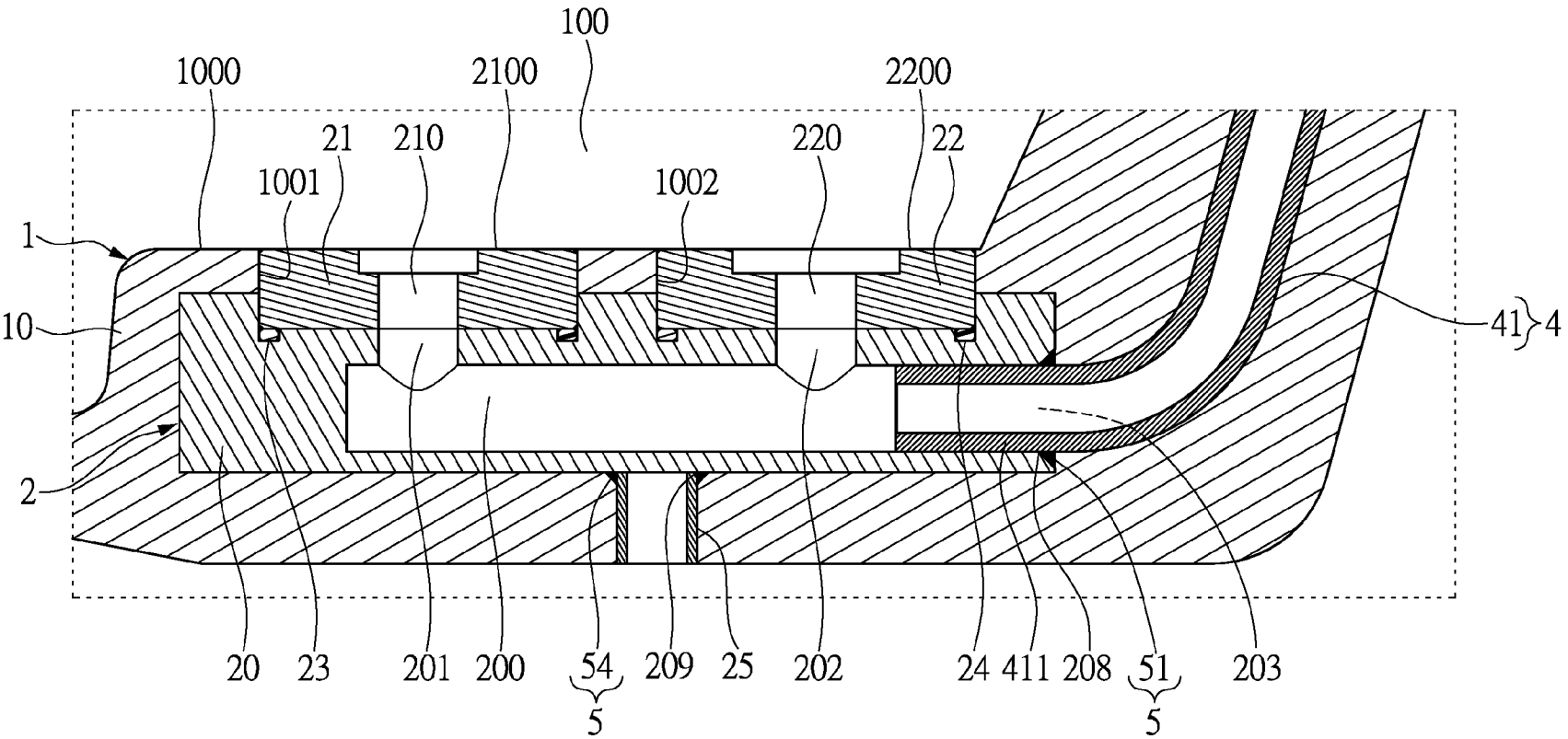
FIG. 3 shows an enlarged schematic view taken on part III of FIG. 2.

More particularly, as shown in FIG. 3, the first inlet structure 21 has a first top surface 2100, and the first top surface 2100 of the first inlet structure 21 and the inner surface 1000 of the container casing member 10 are substantially flush with each other. In addition, the second inlet structure 22 has a second top surface 2200, and the second top surface 2200 of the second inlet structure 22 and the inner surface 1000 of the container casing member 10 are substantially flush with each other.

In addition, referring to FIG. 3 to FIG. 6, the second mold module 3 includes a second mold structure 30. More precisely, the second mold structure 3 has a second inner guide channel 300, a second inlet 301 communicated with the second inner guide channel 300, and a second outlet 302 opposite to the second inlet 301 and communicated with the second inner guide channel 300.

Furthermore, referring to FIG. 3 to FIG. 6, the pipe module 4 includes a first pipe body 41 connected between the first mold structure 20 and the second mold structure 30 and embedded into the container casing member 10, and a second pipe body 42 connected to the second mold structure 30. More precisely, the first pipe body 41 has a first connection portion 411 embedded into the first mold structure 20 and communicated with the first outlet 203 of the first mold structure 20, and a second connection portion 412 embedded into the second mold structure 30 and communicated with the second inlet 301. In addition, the second pipe body 42 has a first connection portion 421 embedded into the second mold structure 30 and communicated with the second outlet 302 of the second mold structure 30, and a second connection portion 422 exposed outside the second mold structure 30 and connected to a nozzle N.

Figure 4:
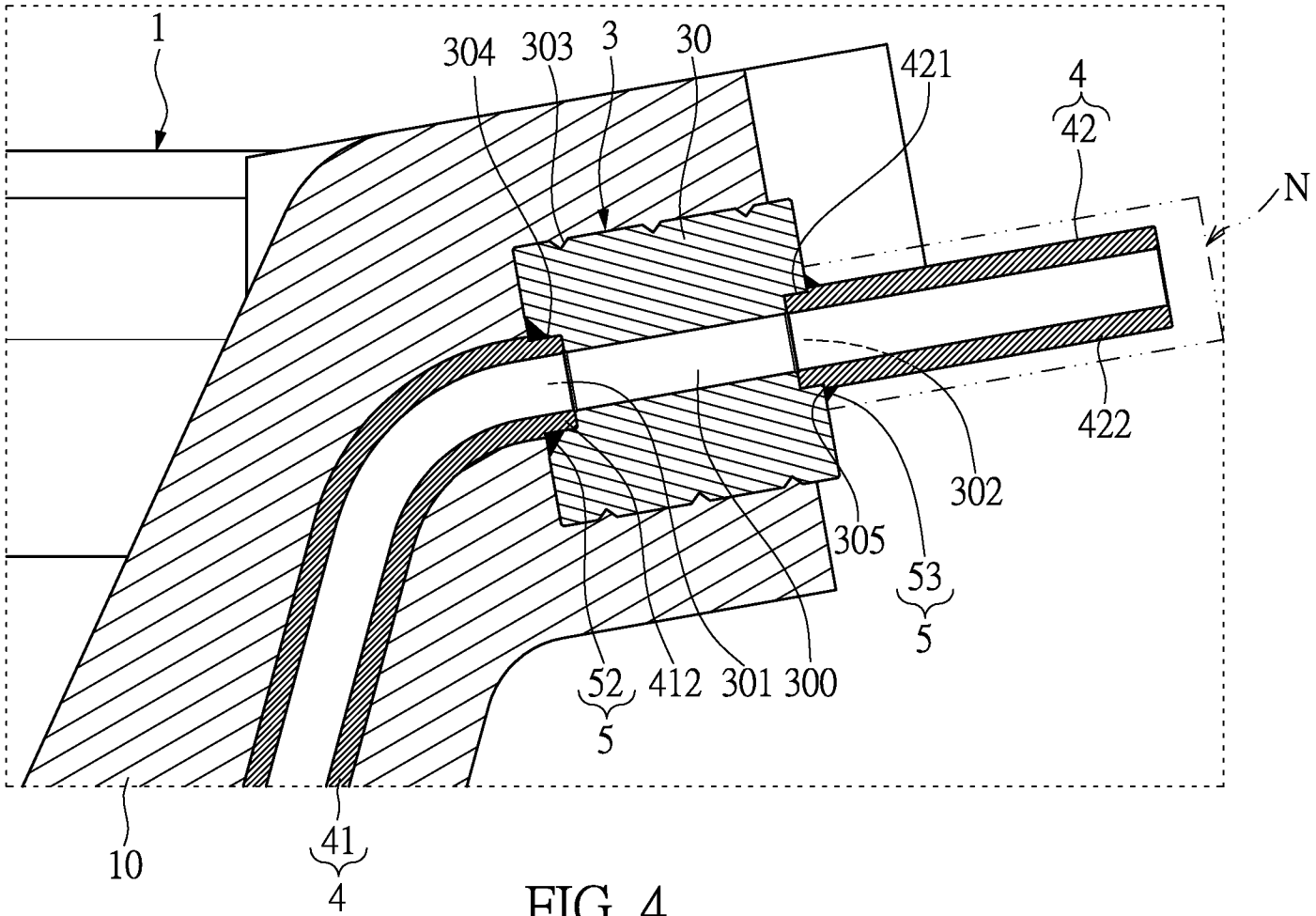
FIG. 4 shows an enlarged schematic view taken on part IV of FIG. 2.
Figure 5:
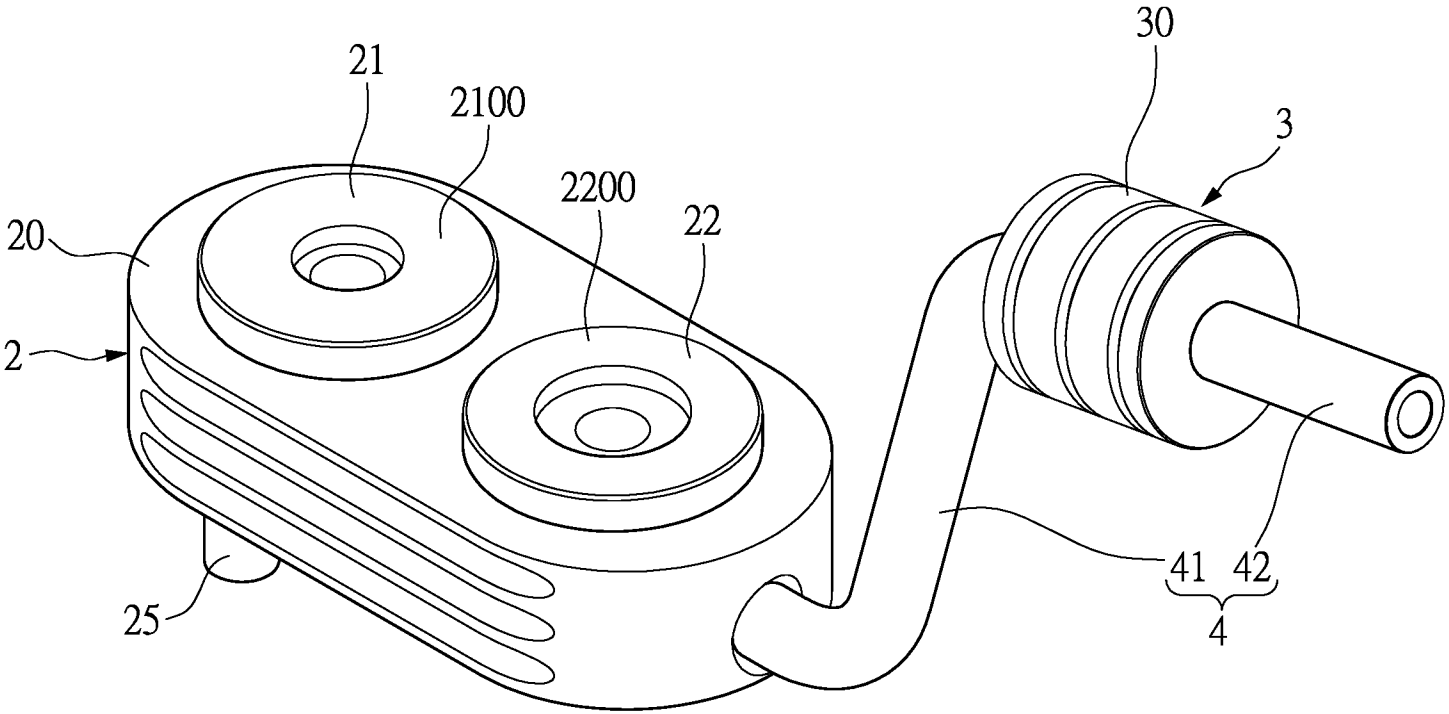
FIG. 5 shows an assembled perspective schematic view of the injection system including a first mold structure, a second mold structure, and a pipe module according to the present disclosure.
Figure 6:
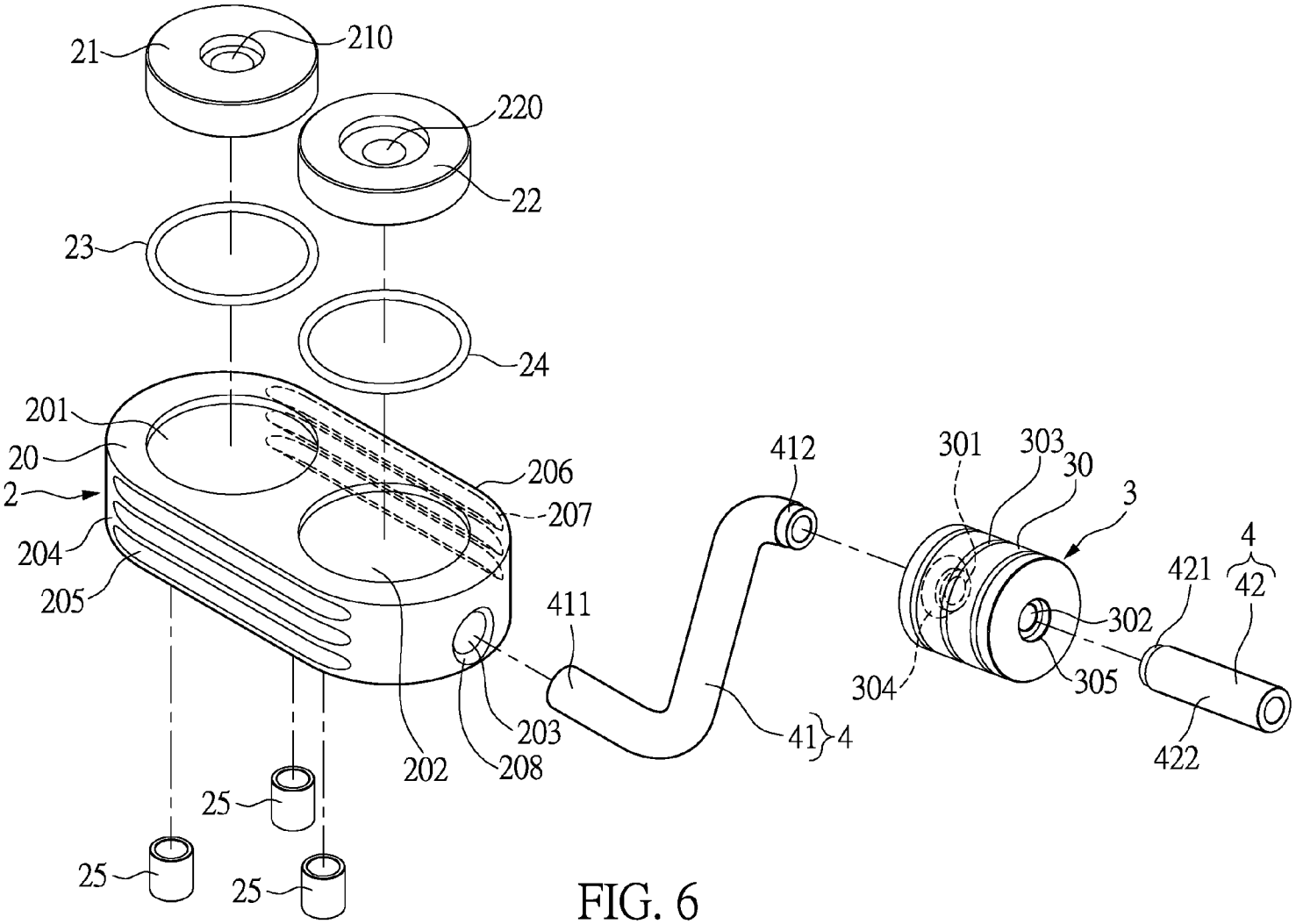
FIG. 6 shows an exploded perspective schematic view of the injection system including a first mold structure, a second mold structure, and a pipe module according to the present disclosure.

For one example, referring to FIG. 3, FIG. 4, and FIG. 6, the first mold module 2 further includes a first buffer structure 23 (or a first cushion structure) disposed between the first inlet structure 21 and the first mold structure 20, and a second buffer structure 24 (or a second cushion structure) disposed between the second inlet structure 22 and the first mold structure 20. In addition, the first buffer structure 23 and the second buffer structure 24 are O-ring seals.

For another example, referring to FIG. 3, FIG. 4, and FIG. 6, the injection system Z applied to a die casting machine further includes an enclosed structure 5. The enclosed structure 5 includes a first surrounding enclosed body 51, a second surrounding enclosed body 52, and a third surrounding enclosed boy 53. The first surrounding enclosed body 51 is disposed on the first mold structure 20 and surrounds the first pipe body 41 for enclosing a first surrounding junction 208 between the first mold structure 20 and the first pipe body 41. The second surrounding enclosed body 52 is disposed on the second mold structure 30 and surrounds the first pipe body 41 for enclosing a second surrounding junction 304 between the second mold structure 30 and the first pipe body 41. The third surrounding enclosed body 53 is disposed on the second mold structure 30 and surrounds the second pipe body 42 for enclosing a third surrounding junction 305 between the second mold structure 30 and the second pipe body 42. For example, the first surrounding enclosed body 51, the second surrounding enclosed body 52, and the third surrounding enclosed boy 53 are weld-all-around enclosed structures formed by full welding.

For yet another example, referring to FIG. 3, FIG. 4, and FIG. 6, the first mold module 2 further includes a plurality of support members 25 disposed on a bottom side of the first mold structure 20 and embedded into the container casing structure 10. In addition, the first mold structure 20 has a plurality of first left positioning grooves 205 disposed on a left lateral wall 204 thereof for contacting the container casing structure 10, the first mold structure 20 has a plurality of first right positioning grooves 207 disposed on a right lateral wall 206 thereof for contacting the container casing structure 10, and the second mold structure 30 has a plurality of second positioning grooves 303 disposed on an outer perimeter surface thereof for contacting the container casing structure 10. Therefore, the first mold module 2 is firmly fixed inside the container casing structure 10 by using the support members 25 and matching the first left positioning grooves 205 and the first right positioning grooves 207.

Please note, referring to FIG. 3, the enclosed structure 5 further includes a plurality of fourth surrounding enclosed bodies 54, and each fourth surrounding enclosed body 54 is disposed on the bottom side of the first mold structure 20 and surrounds the corresponding support member 25 for enclosing a fourth surrounding junction 209 between the first mold structure 20 and the corresponding support member 25. For example, each fourth surrounding enclosed body 54 is a weld-all-around enclosed structure formed by full welding.

Referring to FIG. 7 to FIG. 13, the injection system Z further includes a feeding module 6 and an abutting module 7.

Figure 7:
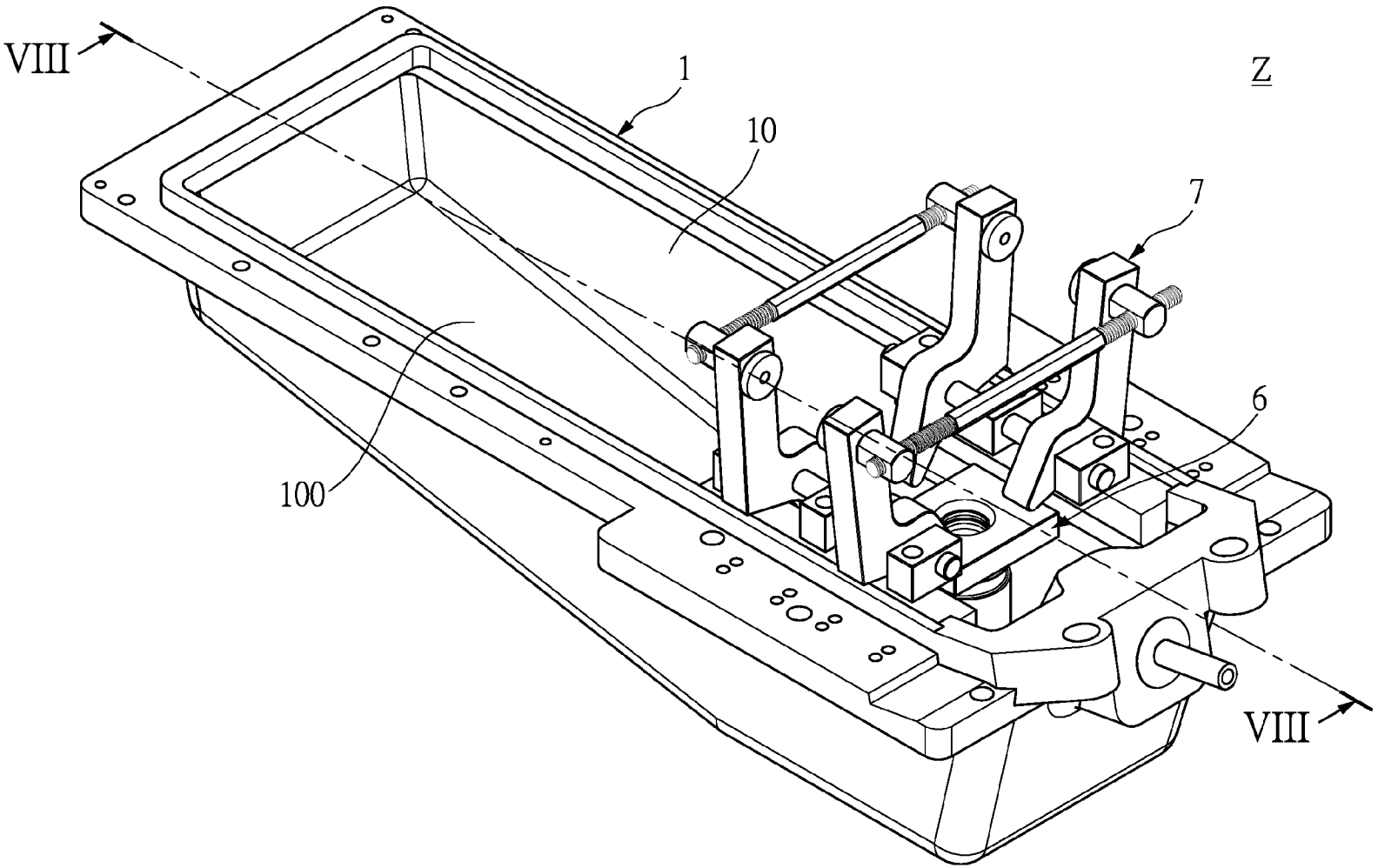
FIG. 7 shows a perspective schematic view of the injection system further including a feeding module and an abutting module according to the present disclosure.
Figure 8:
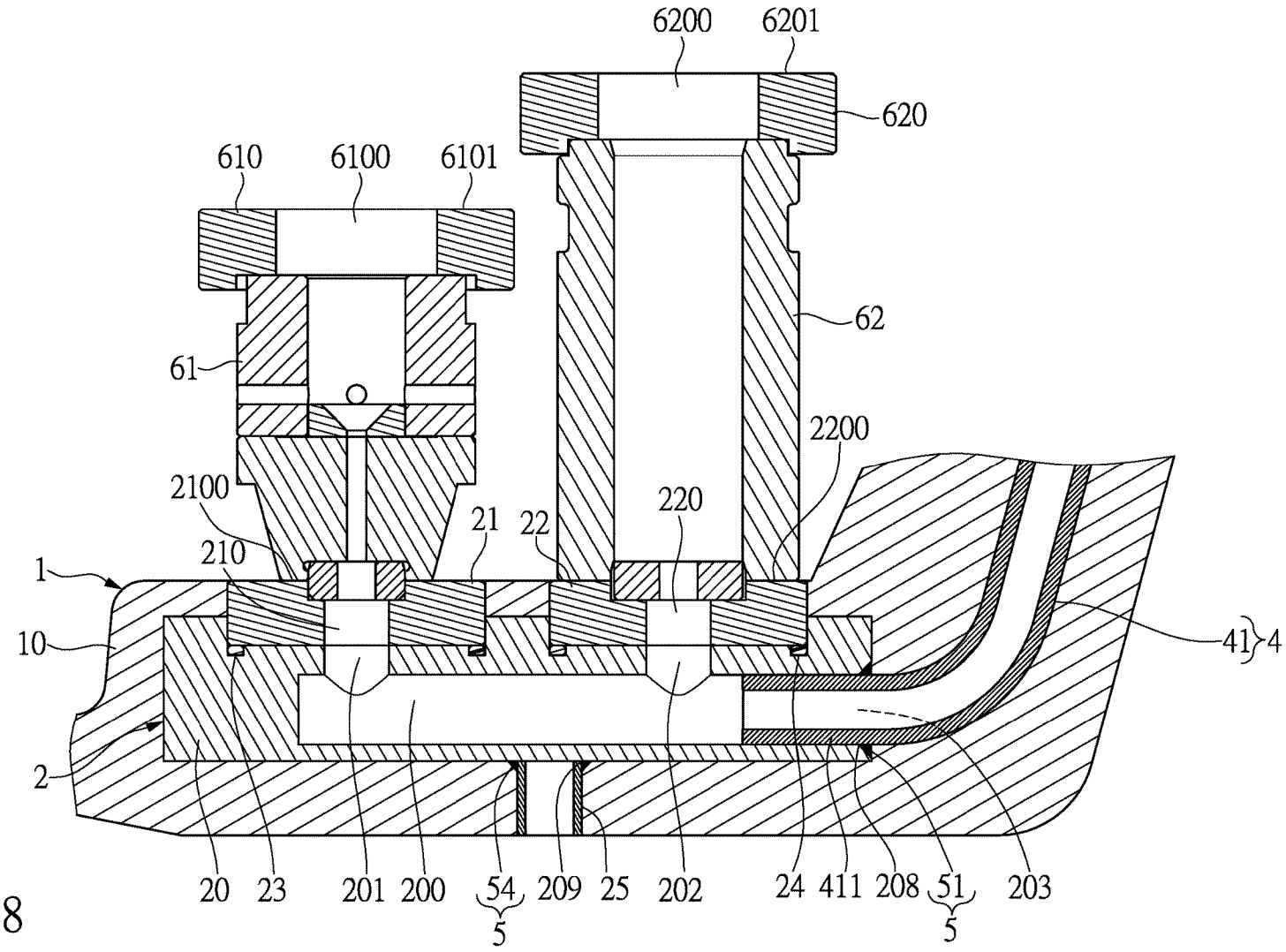
FIG. 8 shows a cross-sectional view taken along the section line VIII-VIII of FIG. 7.

First, referring to FIG. 7 and FIG. 8, the feeding module 6 includes a first feeding assembly 61 having a first pressing board 610 and a second feeding assembly 62 having a second pressing board 620. More particularly, the first pressing board 610 and the second pressing board 620 are respectively disposed on a topmost side of the first feeding assembly 61 and a topmost side of the second feeding assembly 62. In addition, the first feeding assembly 61 is disposed on the first top surface 2100 of the first inlet structure 21 and in fluid communication with the first communication opening 210 of the first inlet structure 21, and the second feeding assembly 62 is disposed on the second top surface 2200 of the second inlet structure 22 and in fluid communication with the second communication opening 220 of the second inlet structure 22.

Figure 9:
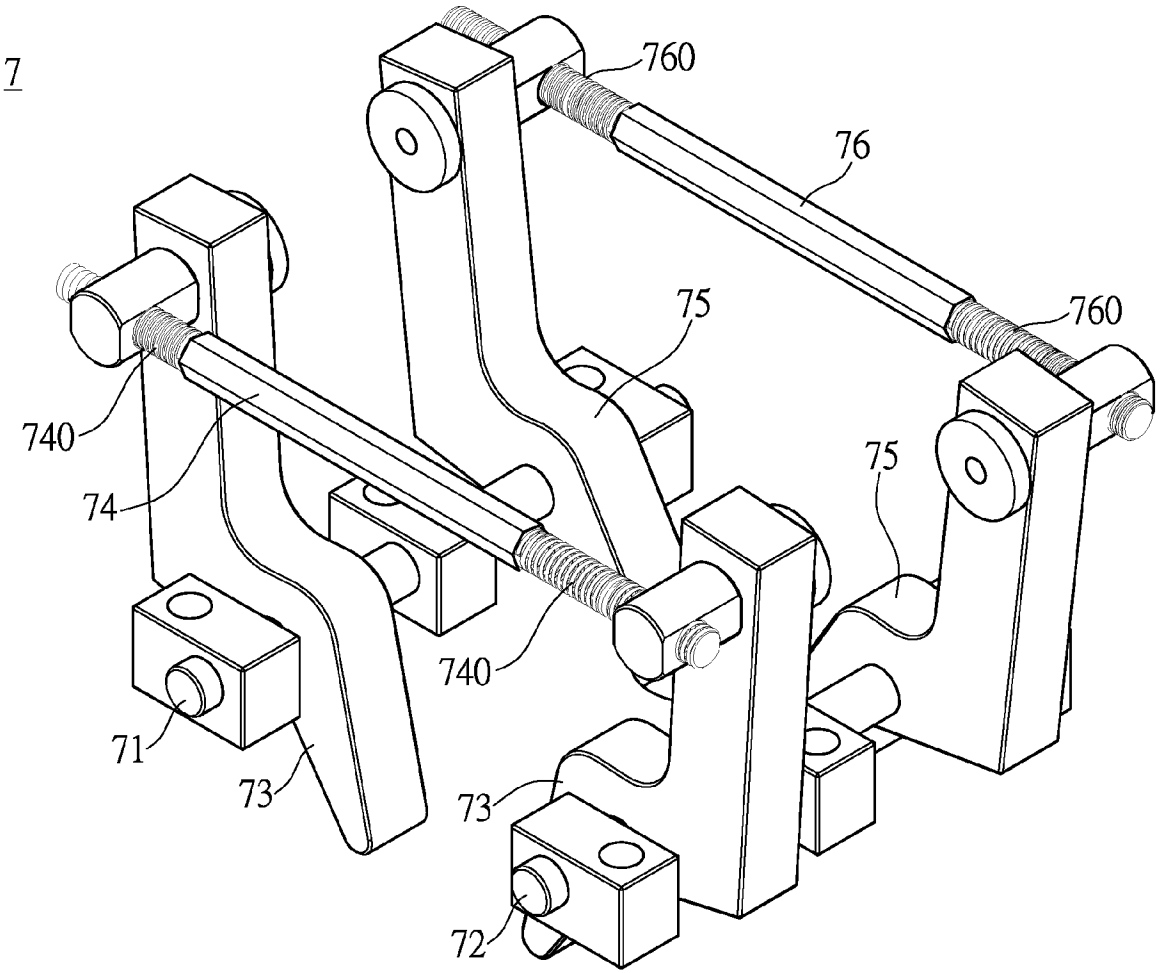
FIG. 9 shows a perspective schematic view of the abutting module of the injection system according to the present disclosure.

Moreover, referring to FIG. 7 and FIG. 9, the abutting module 7 includes a first pivot seat 71, a second pivot seat 72, two first abutting structures 73, a first adjusting member 74, two second abutting structures 75, and a second adjusting member 76.

Figure 10:
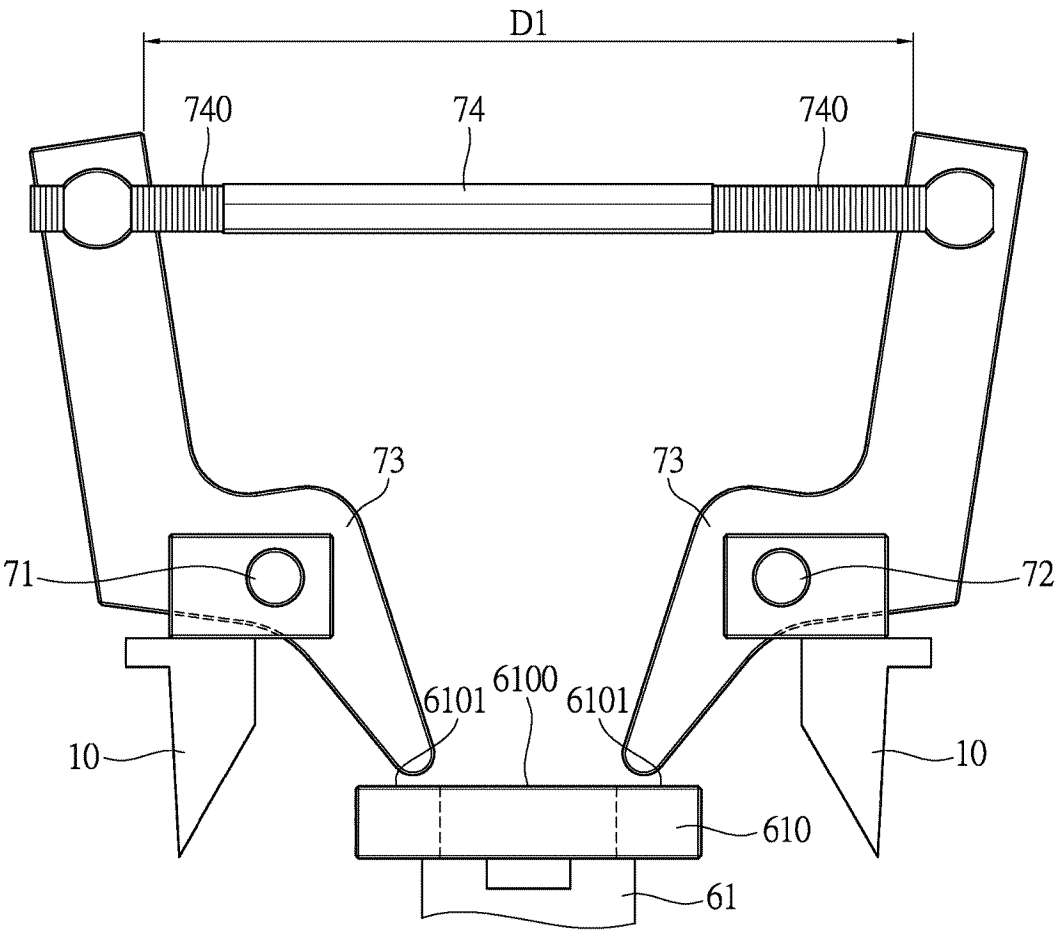
FIG. 10 shows a lateral schematic view of the two first abutting structures of the abutting module of the injection system being concurrently separated from the first pressing board according to the present disclosure.
Figure 11:
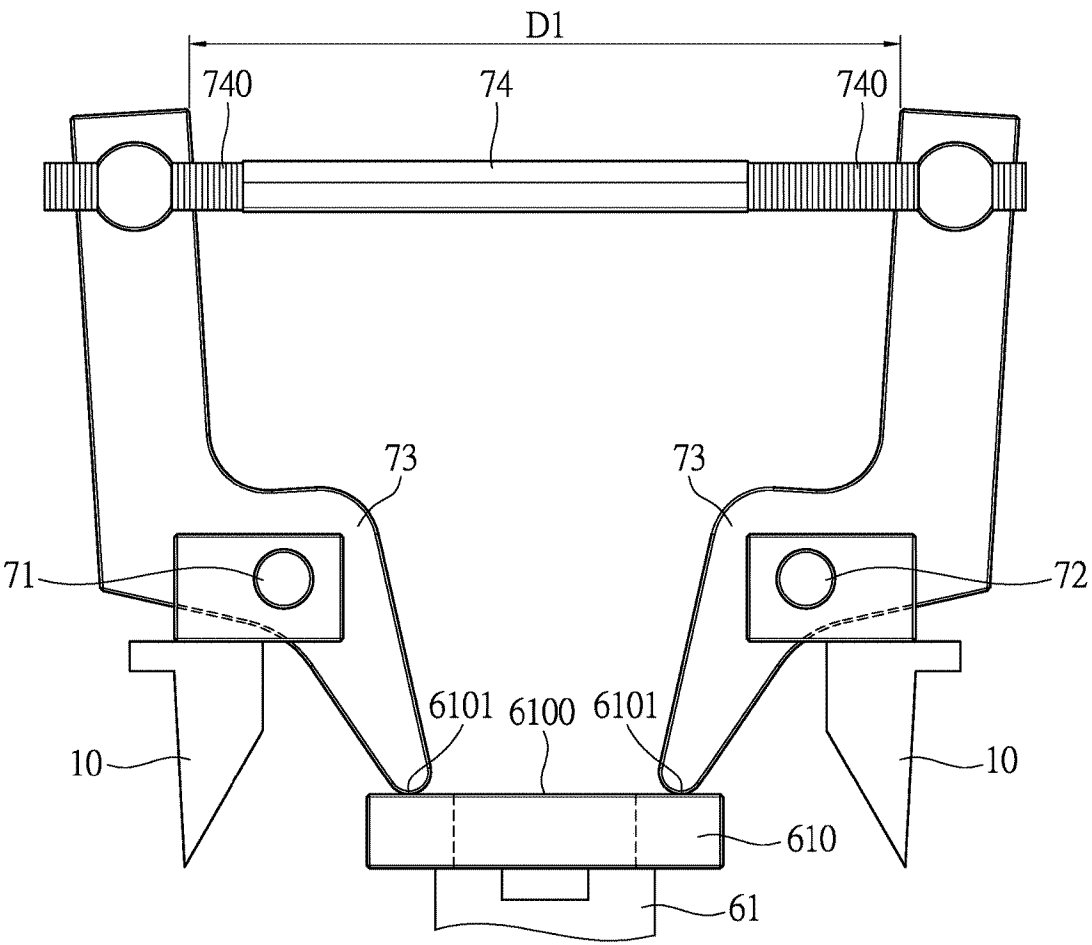
FIG. 11 shows a lateral schematic view of the two first abutting structures of the abutting module of the injection system concurrently downwardly abutting the first pressing board according to the present disclosure.
Figure 12:
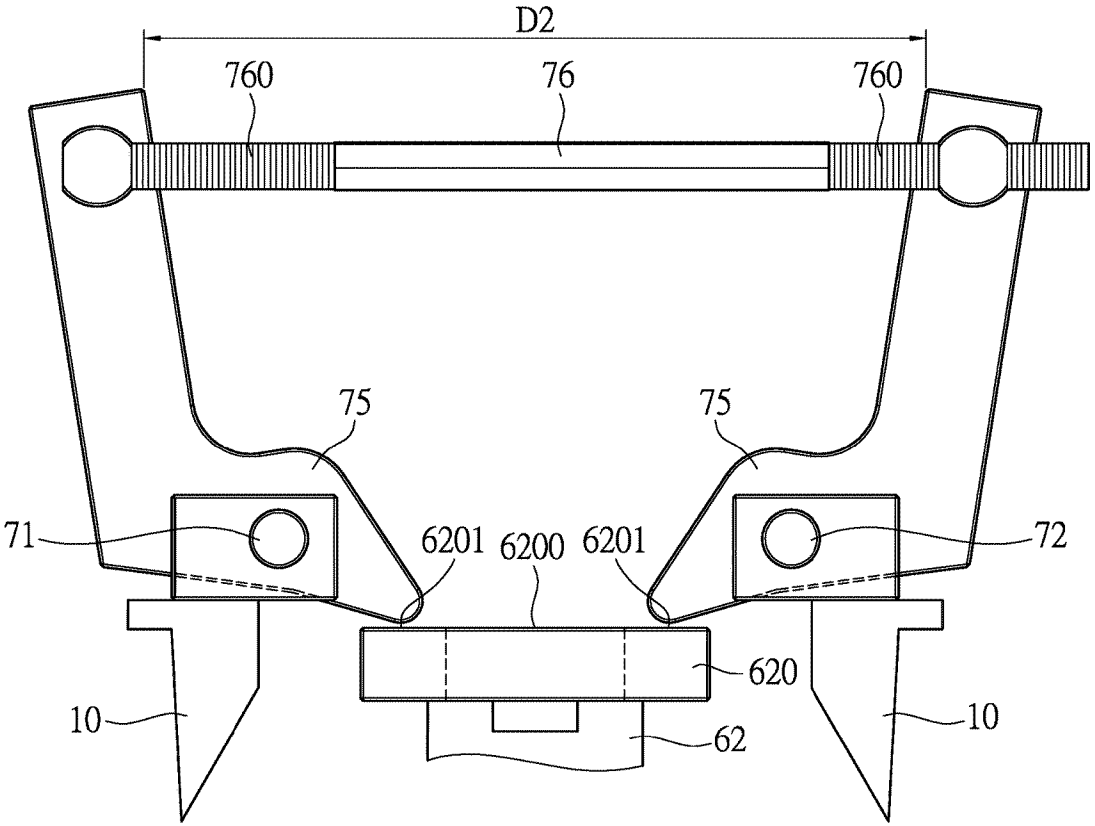
FIG. 12 shows a lateral schematic view of the two second abutting structures of the abutting module of the injection system being concurrently separated from the second pressing board according to the present disclosure.
Figure 13:
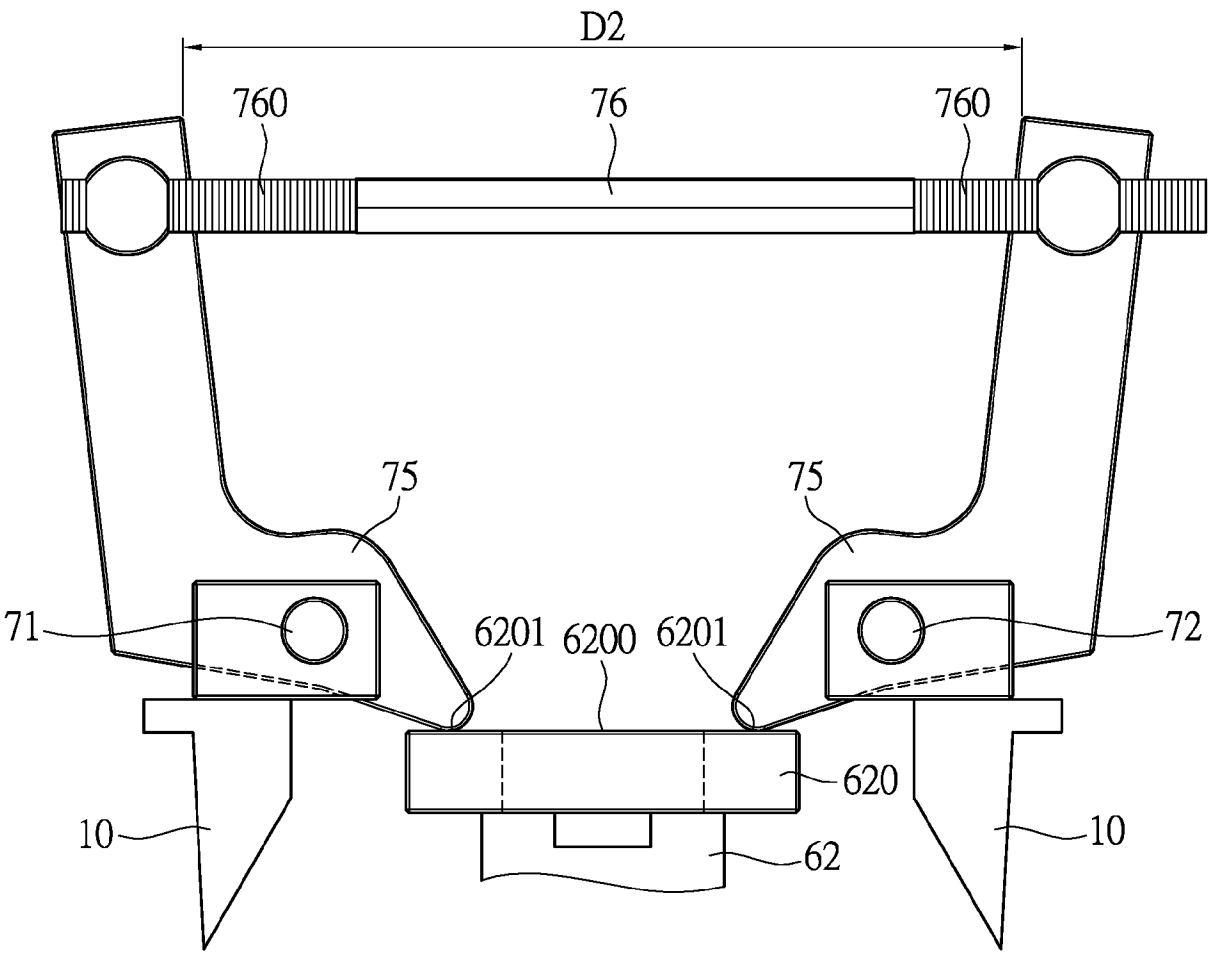
FIG. 13 shows a lateral schematic view of the two second abutting structures of the abutting module of the injection system concurrently downwardly abutting the second pressing board according to the present disclosure.

More particularly, referring to FIG. 9 to FIG. 11, both the first pivot seat 71 and the second pivot seat 72 are positioned on the container casing member 10. The two first abutting structures 73 are respectively pivotably disposed on the first pivot seat 71 and the second pivot seat 72 so as to concurrently separate the two first abutting structures 73 from the first pressing board 610 (as shown in FIG. 10) or concurrently downwardly abutting the first pressing board 610 by the two first abutting structures 73 (as shown in FIG. 11). The first adjusting member 74 is rotatably disposed between the two first abutting structures 73 for adjusting a first distance D1 between the two first abutting structures 73. In addition, referring to FIG. 9, FIG. 12, and FIG. 13, the two second abutting structures 75 are respectively pivotably disposed on the first pivot seat 71 and the second pivot seat 72 so as to concurrently separate the two second abutting structures 75 from the second pressing board 620 (as shown in FIG. 12) or concurrently downwardly abutting the second pressing board 620 by the two second abutting structures 75 (as shown in FIG. 13). The second adjusting member 76 are rotatably disposed between the two second abutting structures 75 for adjusting a second distance D2 between the two second abutting structures 75.

More particularly, referring to FIG. 8 and FIG. 11, the two first abutting structures 73 of the abutting module 7 downwardly abut against the first pressing board 610 so as to firmly position the first feeding assembly 61 on the first top surface 2100 of the first inlet structure 21. That is to say, the first feeding assembly 61 can be firmly positioned on the first top surface 2100 of the first inlet structure 21 by matching the two first abutting structures 73 and the first pressing board 610. In addition, referring to FIG. 8 and FIG. 13, the two second abutting structures 75 of the abutting module 7 downwardly abut against the second pressing board 620 so as to firmly position the second feeding assembly 62 on the second top surface 2200 of the second inlet structure 22. That is to say, the second feeding assembly 62 can be firmly positioned on the second top surface 2200 of the second inlet structure 22 by matching the two second abutting structures 75 and the second pressing board 620. Therefore, referring to FIG. 11 and FIG. 13, the first feeding assembly 61 and the second feeding assembly 62 are respectively firmly positioned on the first inlet structure 21 and the second inlet structure 22 through the abutting module 7.

For example, referring to FIG. 8 and FIG. 11, the first pressing board 610 has a first opening 6100 in fluid communication with the first feeding assembly 61 and a first abutting area 6101 adjacent to the first opening 6100 and abutted by the two first abutting structures 73. In addition, referring to FIG. 8 and FIG. 13, the second pressing board 620 has a second opening 6200 in fluid communication with the second feeding assembly 62 and a second abutting area 6201 adjacent to the second opening 6200 and abutted by the two second abutting structures 75.

More particularly, referring to FIG. 9 and FIG. 11, the first adjusting member 74 has two first screw structures 740 respectively disposed on two opposite end portions thereof, and the two first screw structures 740 respectively pass through the two first abutting structures 73 and respectively rotatably mated with the two first abutting structures 73. Hence, the first distance D1 between the two first abutting structures 73 can be adjusted by rotating 順或逆 the first adjusting member 74. In addition, referring to FIG. 9 and FIG. 13, the second adjusting member 76 has two second screw structures 760 respectively disposed on two opposite end portions thereof, and the two second screw structures 760 respectively pass through the two second abutting structures 75 and respectively rotatably mated with the two second abutting structures 75. Hence, the second distance D2 between the two second abutting structures 75 can be adjusted by rotating 順或逆 the second adjusting member 76. It should be noted that when the first distance D1 between the two first abutting structures 73 is increased, a downward force provided by the two first abutting structures 73 to downwardly abut the first pressing board 610 is increased. When the second distance D2 between the two second abutting structures 75 is increased, a downward force provided by the two second abutting structures 75 to downwardly abut the second pressing board 620 is increased.

In conclusion, the abutting module 7 is disposed on the container casing member 10 for downwardly abutting the first feeding assembly 61 and the second feeding assembly 62, so that the first feeding assembly 61 and the second feeding assembly 62 can be respectively firmly positioned on the first inlet structure 21 and the second inlet structure 22 through the abutting module 7.

Moreover, the corrosion resistance of the first mold module 2 of injection system Z of the present disclosure is increased by matching the first inlet structure 21 and the second inlet structure 22 due to the features of "the first inlet structure 21 disposed on the first mold structure 20 and partially embedded into the container casing member 10" and "the second inlet structure 22 disposed on the first mold structure 20 and partially embedded into the container casing member 10".

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. An injection system applied to a die casting machine, comprising:

a container module including a container casing member;

a first mold module including a first mold structure embedded into the container casing member, a first inlet structure disposed on the first mold structure and partially embedded into the container casing member, and a second inlet structure disposed on the first mold structure and partially embedded into the container casing member, wherein the first inlet structure has a first top surface, and the second inlet structure has a second top surface;

a second mold module including a second mold structure;

a pipe module including a first pipe body connected between the first mold structure and the second mold structure and embedded into the container casing member, and a second pipe body connected to the second mold structure;

a feeding module including a first feeding assembly having a first pressing board and a second feeding assembly having a second pressing board, wherein the first pressing board and the second pressing board are respectively disposed on a topmost side of the first feeding assembly and a topmost side of the second feeding assembly, the first feeding assembly is disposed on the first top surface of the first inlet structure and in fluid communication with the first inlet structure, and the second feeding assembly is disposed on the second top surface of the second inlet structure and in fluid communication with the second inlet structure; and an abutting module including a first pivot seat positioned on the container casing member, a second pivot seat positioned on the container casing member, two first abutting structures respectively pivotably disposed on the first pivot seat and the second pivot seat for concurrently downwardly abutting the first pressing board, a first adjusting member rotatably disposed between the two first abutting structures for adjusting a distance between the two first abutting structures, two second abutting structures respectively pivotably disposed on the first pivot seat and the second pivot seat and concurrently downwardly abutting the second pressing board, and a second adjusting member rotatably disposed between the two second abutting structures for adjusting a distance between the two second abutting structures;

wherein the two first abutting structures downwardly abut against the first pressing board so as to firmly position the first feeding assembly on the first top surface of the first inlet structure;

wherein the two second abutting structures downwardly abut against the second pressing board so as to firmly position the second feeding assembly on the second top surface of the second inlet structure.

2. The injection system of claim 1, wherein the first adjusting member has two first screw structures respectively disposed on two opposite end portions thereof, and the two first screw structures respectively pass through the two first abutting structures and respectively rotatably mated with the two first abutting structures, wherein the second adjusting member has two second screw structures respectively disposed on two opposite end portions thereof, and the two second screw structures respectively pass through the two second abutting structures and respectively rotatably mated with the two second abutting structures.

3. The injection system of claim 1, wherein the first pressing board has a first opening in fluid communication with the first feeding assembly and a first abutting area adjacent to the first opening and abutted by the two first abutting structures, and the second pressing board has a second opening in fluid communication with the second feeding assembly and a second abutting area adjacent to the second opening and abutted by the two second abutting structures, wherein the container casing member has an inner surface, the first top surface of the first inlet structure and the inner surface of the container casing member are flush with each other, and the second top surface of the second inlet structure and the inner surface of the container casing member are flush with each other.

4. The injection system of claim 1, wherein the container casing member has a material receiving space, the first mold structure has a first inner guide channel, a first left inlet communicated with the first inner guide channel, a first right inlet communicated with the first inner guide channel, and a first outlet communicated with the first inner guide channel, the first inlet structure has a first communication opening communicated between the material receiving space and the first left inlet, and the second inlet structure has a second communication opening communicated between the material receiving space and the first right inlet, wherein the second mold structure has a second inner guide channel, a second inlet communicated with the second inner guide channel, and a second outlet opposite to the second inlet and communicated with the second inner guide channel, wherein the first pipe body has a first connection portion embedded into the first mold structure and communicated with the first outlet of the first mold structure, and a second connection portion embedded into the second mold structure and communicated with the second inlet, and the second pipe body has a first connection portion embedded into the second mold structure and communicated with the second outlet of the second mold structure, and a second connection portion exposed outside the second mold structure and connected to a nozzle.

5. The injection system of claim 4, wherein the container casing member has a first groove for receiving the first inlet structure, and a second groove for receiving the second inlet structure, and the first mold module further includes a first buffer structure disposed between the first inlet structure and the first mold structure, and a second buffer structure disposed between the second inlet structure and the first mold structure.

6. The injection system of claim 4, further comprising an enclosed structure including a first surrounding enclosed body, a second surrounding enclosed body, and a third surrounding enclosed boy, wherein the first surrounding enclosed body is disposed on the first mold structure and surrounds the first pipe body for enclosing a first surrounding junction between the first mold structure and the first pipe body, the second surrounding enclosed body is disposed on the second mold structure and surrounds the first pipe body for enclosing a second surrounding junction between the second mold structure and the first pipe body, and the third surrounding enclosed body is disposed on the second mold structure and surrounds the second pipe body for enclosing a third surrounding junction between the second mold structure and the second pipe body.

7. The injection system of claim 4, wherein the first mold module further includes a plurality of support members disposed on a bottom side of the first mold structure and embedded into the container casing structure, the first mold structure has a plurality of first left positioning grooves disposed on a left lateral wall thereof for contacting the container casing structure, the first mold structure has a plurality of first right positioning grooves disposed on a right lateral wall thereof for contacting the container casing structure, and the second mold structure has a plurality of second positioning grooves disposed on an outer perimeter surface thereof for contacting the container casing structure.

8. An injection system applied to a die casting machine, comprising:

a container module including a container casing member;

a first mold module including a first inlet structure partially embedded into the container casing member, and a second inlet structure partially embedded into the container casing member, wherein the first inlet structure has a first top surface, and the second inlet structure has a second top surface;

a feeding module including a first feeding assembly and a second feeding assembly, wherein the first feeding assembly is disposed on the first top surface of the first inlet structure and in fluid communication with the first inlet structure, and the second feeding assembly is disposed on the second top surface of the second inlet structure and in fluid communication with the second inlet structure; and an abutting module including two first abutting structures and two second abutting structures;

wherein the two first abutting structures downwardly abut against the first feeding assembly so as to firmly position the first feeding assembly on the first top surface of the first inlet structure;

wherein the two second abutting structures downwardly abut against the second feeding assembly so as to firmly position the second feeding assembly on the second top surface of the second inlet structure;

wherein the container casing member has an inner surface, the first top surface of the first inlet structure and the inner surface of the container casing member are flush with each other, and the second top surface of the second inlet structure and the inner surface of the container casing member are flush with each other.

9. An injection system applied to a die casting machine, comprising:

a container module including a container casing member;

a first mold module including a first inlet structure partially embedded into the container casing member, and a second inlet structure partially embedded into the container casing member;

a feeding module including a first feeding assembly and a second feeding assembly, wherein the first feeding assembly is disposed on the first inlet structure, and the second feeding assembly is disposed on the second inlet structure; and an abutting module disposed on the container casing member for downwardly abutting the first feeding assembly and the second feeding assembly;

wherein the abutting module downwardly abuts the first feeding assembly so as to firmly position the first feeding assembly on the first inlet structure;

wherein the abutting module downwardly abuts the second feeding assembly so as to firmly position the second feeding assembly on the second inlet structure.

10. The injection system of claim 9, wherein the container casing member has an inner surface, the first inlet structure has a first top surface flush with the inner surface of the container casing member, and the second inlet structure has a second top surface flush with the inner surface of the container casing member.

* * * * *